US009140470B2

(12) United States Patent
Verma et al.

(10) Patent No.: US 9,140,470 B2
(45) Date of Patent: Sep. 22, 2015

(54) EJECTOR

(75) Inventors: Parmesh Verma, Manchester, CT (US); Frederick J. Cogswell, Glastonbury, CT (US); Jinliang Wang, Ellington, CT (US)

(73) Assignee: Carrier Corporation, Farmington, CT (US)

( * ) Notice: Subject to any disclaimer, the term of this patent is extended or adjusted under 35 U.S.C. 154(b) by 134 days.

(21) Appl. No.: 13/821,111

(22) PCT Filed: Nov. 1, 2011

(86) PCT No.: PCT/US2011/058747

§ 371 (c)(1), (2), (4) Date: Mar. 6, 2013

(87) PCT Pub. No.: WO2012/074650

PCT Pub. Date: Jun. 7, 2012

(65) Prior Publication Data

US 2013/0239600 A1 Sep. 19, 2013

Related U.S. Application Data

(60) Provisional application No. 61/418,045, filed on Nov. 30, 2010.

(51) Int. Cl.
*F25B 1/06* (2006.01)
*F25B 41/00* (2006.01)

(52) U.S. Cl.
CPC . *F25B 1/06* (2013.01); *F25B 41/00* (2013.01); *F25B 2341/0012* (2013.01); *F25B 2341/0013* (2013.01)

(58) Field of Classification Search
CPC ..... F25B 1/06; F25B 9/08; F25B 2341/001; F25B 2341/0011; F25B 2341/0012; F25B 2341/0013; F25B 2341/0014; F25B 2341/0015; F25B 2341/0016
See application file for complete search history.

(56) References Cited

U.S. PATENT DOCUMENTS 1,836,318 A 12/1931 Gay
3,277,660 A 10/1966 Kemper et al.
(Continued)

FOREIGN PATENT DOCUMENTS

CN 1267686 C 8/2006
CN 101737990 A 6/2010
(Continued)

OTHER PUBLICATIONS

European Patent Office Action for EP Patent Application No. 11 781 944.1, dated Mar. 7, 2014.
International Search Report and Written Opinion for PCT/US2011/058747, dated Feb. 24, 2012.
Chinese Office action for Chinese Patent Application No. 201180057597.8, dated Nov. 28, 2014.

*Primary Examiner* — Frantz Jules
*Assistant Examiner* — Erik Mendoza-Wilkenfel
(74) *Attorney, Agent, or Firm* — Bachman & LaPointe, P.C.

(57) ABSTRACT

An ejector has a primary inlet (40), a secondary inlet (42), and an outlet (44). A primary flowpath extends from the primary inlet to the outlet. A secondary flowpath extends from the secondary inlet to the outlet. A mixer convergent section (114; 300; 400) is downstream of the secondary inlet. A motive nozzle (100) surrounds the primary flowpath upstream of a junction with the secondary flowpath. The motive nozzle has a throat (106) and an exit (110). An actuator (204) is coupled to the motive nozzle to drive a relative streamwise shift of the exit and convergent section.

22 Claims, 3 Drawing Sheets

(56) References Cited

U.S. PATENT DOCUMENTS

| | | | | |
|---|---|---|---|---|
| 5,036,886 | A * | 8/1991 | Olsen et al. | 137/625.65 |
| 6,877,960 | B1 * | 4/2005 | Presz et al. | 417/198 |
| 6,941,768 | B2 * | 9/2005 | Ikegami et al. | 62/500 |
| 2004/0089019 | A1 | 5/2004 | Kawamura et al. | |
| 2006/0266072 | A1 | 11/2006 | Takeuchi et al. | |
| 2008/0060378 | A1 | 3/2008 | Gocho et al. | |
| 2009/0297339 | A1 * | 12/2009 | Schott et al. | 415/148 |

FOREIGN PATENT DOCUMENTS

| | | | |
|---|---|---|---|
| JP | 2005233121 | A | 9/2005 |
| JP | 2005282507 | A | 10/2005 |

* cited by examiner

EJECTOR

CROSS-REFERENCE TO RELATED APPLICATION

Benefit is claimed of U.S. patent application Ser. No. 61/418,045, filed Nov. 30, 2010, and entitled "Ejector", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser

118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths extend from the primary inlet and secondary inlet to the outlet, merging at the exit. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

SUMMARY

One aspect of the disclosure involves an ejector having a primary inlet, a secondary inlet, and an outlet. A primary flowpath extends from the primary inlet to the outlet. A secondary flowpath extends from the secondary inlet to the outlet. A mixer convergent section is downstream of the secondary inlet. A motive nozzle surrounds the primary flowpath upstream of a junction with the secondary flowpath. The motive nozzle has a throat and an exit. An actuator is coupled to the motive nozzle to drive a relative streamwise shift of the exit and convergent section.

In various implementations, the coupling may be effective to provide the relative streamwise shift along a range of motion between a relatively extended condition and a relatively retracted condition. Over at least a portion of the range of motion, the exit may be within the convergent section. A needle may be mounted for reciprocal movement along the primary flowpath between a first position and a second position. A needle actuator may be coupled to the needle to drive the movement of the needle relative to the motive nozzle.

Other aspects of the disclosure involve a refrigeration system having a compressor, a heat rejection heat exchanger coupled to the compressor to receive refrigerant compressed by the compressor, a heat absorption heat exchanger, a separator, and such an ejector. An inlet of the separator may be coupled to the outlet of the ejector to receive refrigerant from the ejector.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
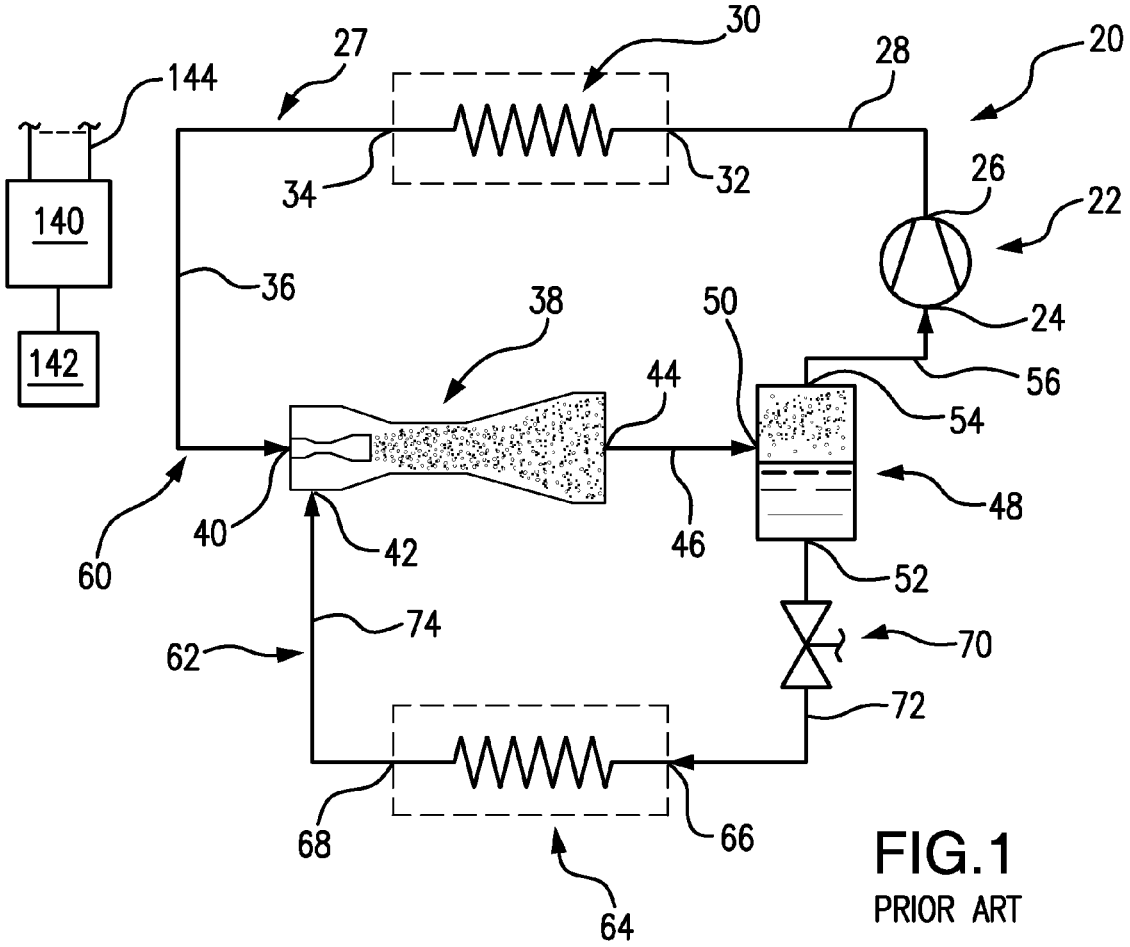
FIG.1 PRIOR ART
FIG. 1 is a schematic view of a prior art ejector refrigeration system.
Figure 2:
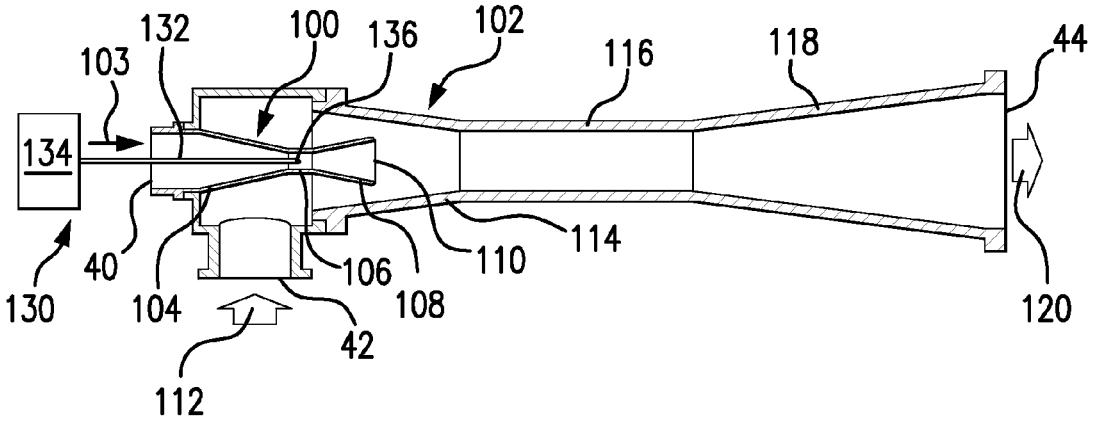
FIG. 2 PRIOR ART
FIG. 2 is an axial sectional view of a prior art ejector.
Figure 3:
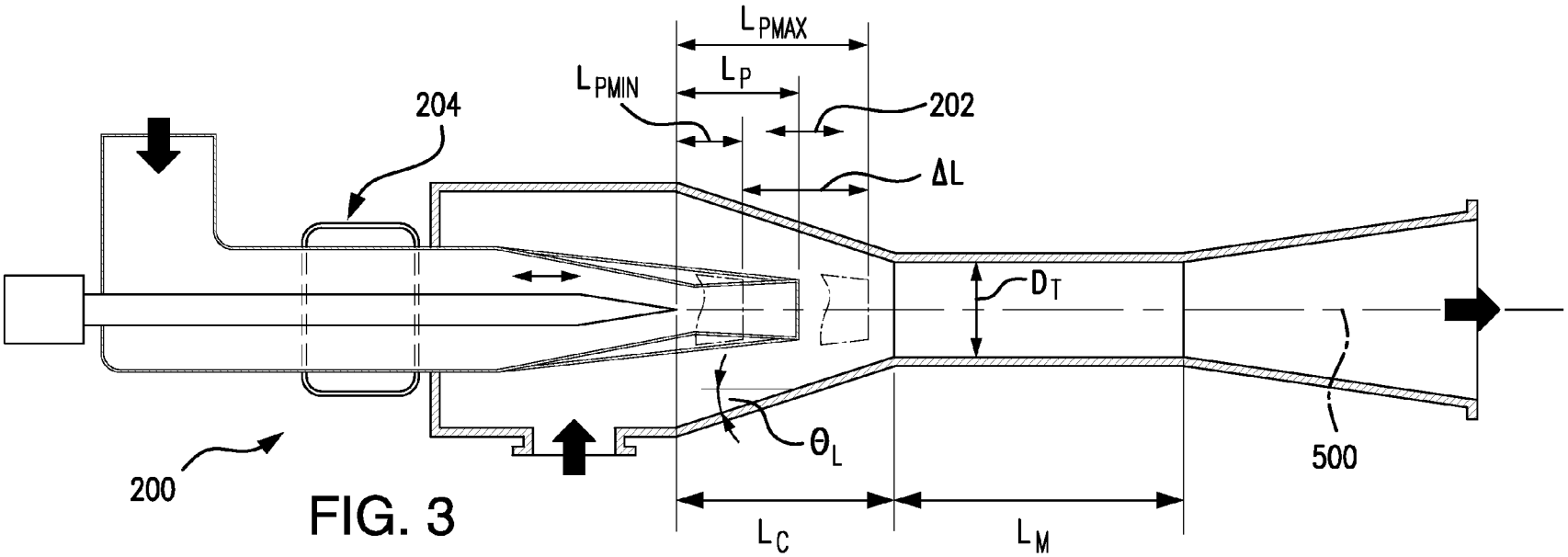
FIG. 3 is a schematic axial sectional view of an ejector.
Figure 4:
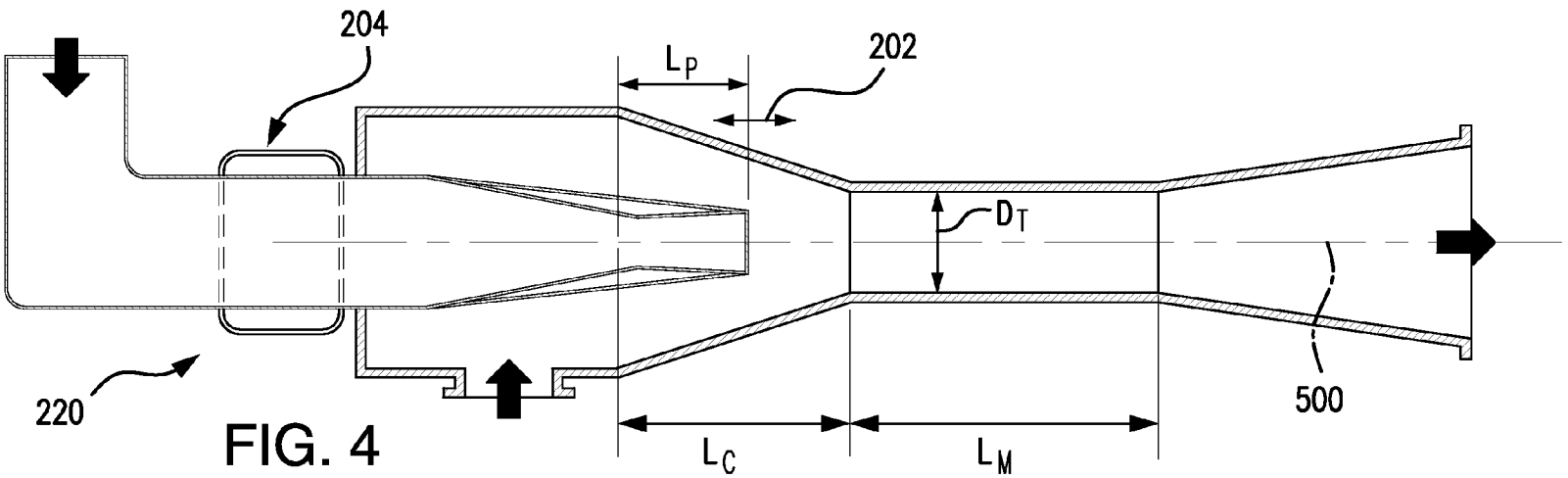
FIG. 4 is a schematic axial second view of a second ejector.

FIG. 3 shows an ejector 200. The ejector 200 may be formed as a modification of the ejector 38 and may be used in systems where conventional ejectors are presently used or may be used in the future. The convergent section 114 is shown having a length $L_C$ and a half angle (e.g., conical half angle about the central longitudinal axis (centerline) 500) $\theta_C$. The mixing section 116 is shown having a length $L_M$. The motive nozzle 100 protrudes into the convergent section of the mixer by an overlap or protrusion length L. The overlap may be controllable by means for controlling the relative streamwise positions of the motive nozzle exit and the convergent section. Exemplary means shifts the exit streamwise relative to the convergent section (e.g., via reciprocal linear motion 202). Exemplary means comprises an actuator 204. An exemplary actuator 204 shifts the motive nozzle while the convergent section remains fixed relative to the environment. The exemplary actuator 204 shifts the motive nozzle and needle as a unit so that the needle actuator 134 still provides relative motion of the needle to the motive nozzle. An exemplary actuator comprises a step motor and transmission to provide linear movement (e.g., pinion and rack system that transfers the motor rotation into the liner reciprocal movement of the motive nozzle). FIG. 4 shows a nozzle 220 lacking a needle and associated control hardware but having the overlap (protrusion) $L_P$ as the only adjustable or controllable parameter.

With a traditional ejector, as operating conditions change, mixing conditions may change. If initial operation is at an optimal condition (e.g., a design target condition) changes in system conditions may increase friction and mixing losses and decrease pressure recoveries in the mixer and/or diffuser. The relative motive nozzle position may be controlled by the control system 140 to compensate for changes in system operating condition. The motive nozzle may be moved forward or backward (upstream or downstream) as needed responsive to sensed parameters (e.g., the outlet pressure or the pressure lift ratio). This may be combined with control of needle position if available.

The shift may be performed, for example, to maximize the ejector's performance, and therefore the system efficiency. One or more operational parameters of the ejector or the system may be sensed. The controller may be programmed to determine an ejector efficiency or a proxy therefor. Responsive to the sensed operational parameters or the calculated efficiency or proxy, the controller may be programmed to cause the actuator to drive the shift.

The controller may vary the motive nozzle position in order to maximize system coefficient of performance (COP). The system COP is highest when the pressure rise achieved by the ejector from the secondary inlet (suction port) to the outlet (exit port) is highest. The controller may dynamically sense (via pressure sensors) the actual pressure rise by measuring pressure at the ejector outlet and the ejector suction port and subtracting these two values. The controller then moves the motive nozzle position to find the peak pressure rise value. If $L_P$ is too large (i.e., the motive nozzle is extended too far into the mixing section of the ejector), then the ejector performance will be poor and the pressure rise small. If $L_P$ is too small (the nozzle is too far from the mixing section of the ejector), then the same is true. At the ideal motive nozzle location the pressure rise is maximized.

The process may be an iterative optimization (e.g., a back and forth iterative stepwise or continuous movement until a desired condition (e.g., an optimized condition) is reached. The optimization may be performed from the instantaneous position (e.g., a slight movement in each direction followed by choosing whichever direction improved performance and then repeating) or by a scan-like movement (e.g., across the entire range of motion or portion thereof and choosing the position that provided the best performance).

Figure 5:
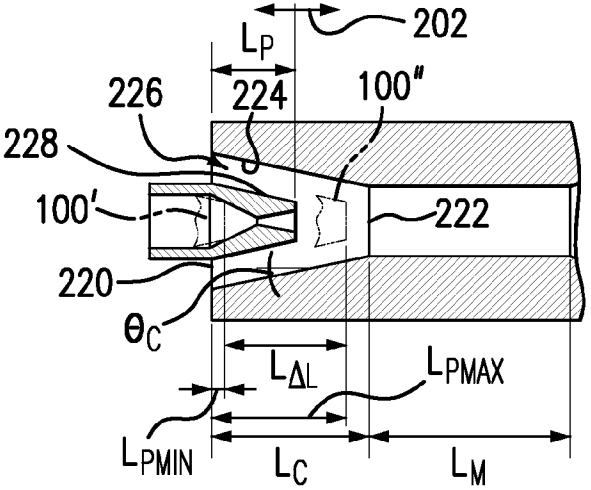
FIG. 5 is a partial further schematic view of the ejector of FIG. 4.

FIG. 5 shows a range of motion of the motive nozzle between a maximally retracted (withdrawn) position 100' with a protrusion $L_{PMIN}$ and a maximally inserted (extended) position 100" with a protrusion $L_{PMAX}$. An exemplary ratio of $L_C$ to $L_M$ is 0.05-60, more narrowly, 0.02-20, more narrowly, 0.2-10. An exemplary ratio of the overlap $L_P$ to the length $L_C$ is in the range of −0.5-1.5, more narrowly, 0.2-0.9. The range of motion may encompass such exemplary position. The range of motion ΔL may encompass that entire range of 0.2-0.9. More narrowly, the exemplary range of motion may include ratios of said overlap to said length including at least 0.4-0.7. An exemplary range of motion ΔL may thus be at least 0.3 (more narrowly, at least 0.5) of said length $L_C$. Alternatively characterized, ΔL may be at least 0.1 of a mixer minimum diameter $D_{MIX}$, more narrowly, at least 0.2 or 0.3-

2.0. The exemplary angle $\theta_C$ is 1-75°, more narrowly, 5-45°, more narrowly, 10-30°. This may be measured as an overall half angle between the upstream end 220 of the convergent section and the downstream end 222 of the convergent section or as a median or modal angle. Thus, the angle of convergence need not be constant. Along the exemplary convergent section, not only does the wall 224 of the convergent section converge but the cross-sectional area of the annular space 226 between the wall 224 and the exterior surface 228 of the motive nozzle converge.

Figure 6:
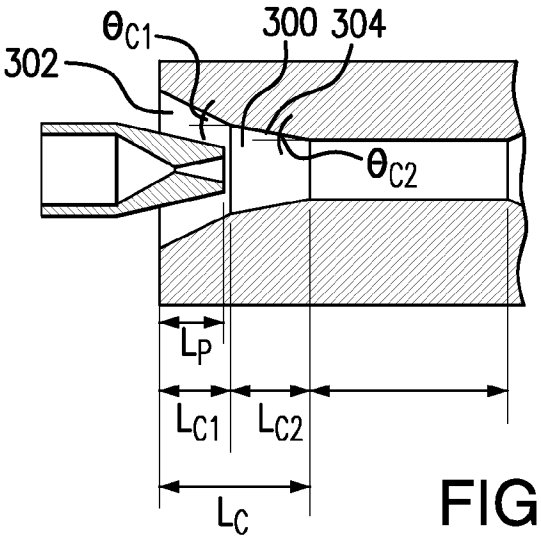
FIG. 6 is a partial schematic sectional view of an alternate ejector.

FIG. 6 shows a convergent section 300 having an upstream portion 302 and a downstream portion 304 of differing angles $\theta_{C1}$ and $\theta_{C2}$ and different respective lengths $L_{C1}$ and $L_2$. Exemplary $\theta_1$ is larger than $\theta_2$. However, both may be in the ranges discussed above as may be the linear dimensions. Similarly, total protrusion of the motive nozzle into the convergent section 300 may be similar to that described above.

Figure 7:
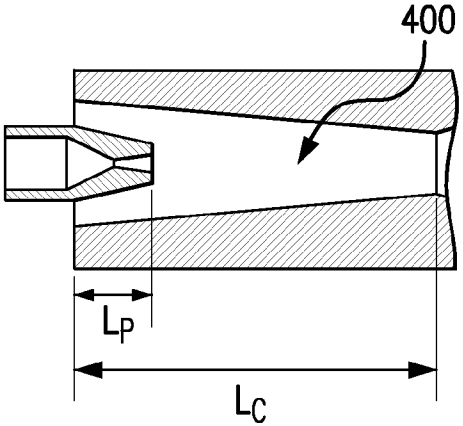
FIG. 7 is a partial schematic sectional view of another alternate ejector.

FIG. 7 shows an ejector wherein the convergent and constant area sections are effectively combined in a relatively long and shallow convergent section 400. Exemplary ratios of $L_P$ to $L_C$ are –0.1-0.6, more narrowly, 0.1-0.4 or 0.2-0.4. Exemplary $\theta_C$ is 2-25°, more narrowly, 5-20° or 10-20°.

Figure 8:
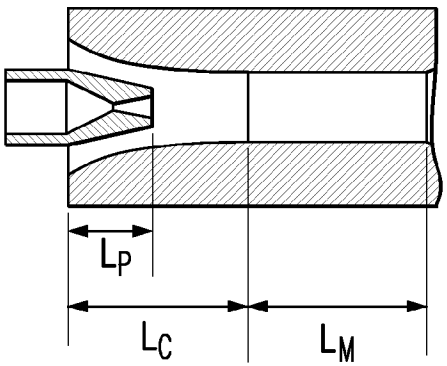
FIG. 8 is a partial schematic sectional view of another alternate ejector.

FIG. 8 modifies the FIG. 6 configuration providing smoothly, continuously changing angle of convergence in the convergent section. Overall dimensions and ratios may be similar.

The system may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. An ejector comprising:
a primary inlet;
a secondary inlet;
an outlet;
a primary flowpath from the primary inlet to the outlet;
a secondary flowpath from the secondary inlet to the outlet;
a mixer convergent section downstream of the secondary inlet;
a motive nozzle surrounding the primary flowpath upstream of a junction with the secondary flowpath and having:
a throat; and
an exit; and
an actuator coupled to the motive nozzle to drive a relative streamwise shift of the motive nozzle exit and mixer convergent section, wherein:
the coupling is effective to provide said relative streamwise shift along a range of motion between a relatively extended condition and a relatively retracted condition;
the secondary flowpath passes along an exterior surface of the motive nozzle that experiences the relative streamwise shift;
over at least a portion of said range of motion, the exit is within the convergent section;
the convergent section has a length ($L_C$);
the motive nozzle, in said portion of said range of motion, protrudes into the convergent section by an overlap ($L_P$); and
said portion includes ratios of said overlap to said length including at least 0.4-0.7.

2. The ejector of claim 1 wherein:
said range of motion ($\Delta L$) is at least 0.1 of a mixer minimum diameter ($D_{MIX}$).

3. The ejector of claim 1 further comprising:
a needle mounted for reciprocal movement along the primary flowpath between a first position and a second position; and
a needle actuator coupled to the needle to drive said movement of the needle relative to the motive nozzle.

4. The ejector of claim 1 wherein:
the actuator comprises a step motor.

5. The ejector of claim 1 wherein:
said portion includes said ratio of 0.2-0.9.

6. The ejector of claim 1 wherein:
said range of motion is 0.3-2.0 of a mixer minimum diameter ($D_{MIX}$).

7. The ejector of claim 1 wherein:
an overall half angle along said length is 5-30°.

8. An ejector comprising:
a primary inlet;
a secondary inlet;
an outlet;
a primary flowpath from the primary inlet to the outlet;
a secondary flowpath from the secondary inlet to the outlet;
a convergent section downstream of the secondary inlet;
a motive nozzle surrounding the primary flowpath upstream of a junction with the secondary flowpath and having:
a throat; and
an exit; and
means for shifting the exit streamwise relative to the convergent section over a range of motion including ratios of overlap between the motive nozzle and convergent section to length of the convergent section of at least 0.4-0.7.

9. The ejector of claim 8 wherein:
said range of motion ($\Delta L$) is at least 0.1 of a mixer minimum diameter ($D_{MIX}$).

10. The ejector of claim 8 wherein:
said range of motion is 0.3-2.0 of a mixer minimum diameter ($D_{MIX}$).

11. A refrigeration system comprising:
a compressor;
a heat rejection heat exchanger coupled to the compressor to receive refrigerant compressed by the compressor;
the ejector of claim 8;
a heat absorption heat exchanger; and
a separator having:
an inlet coupled to the outlet of the ejector to receive refrigerant from the ejector;
a gas outlet; and
a liquid outlet.

12. The system of claim 8 further comprising:
a controller programmed to control operation of the actuator.

13. A method for operating the system of claim 8 comprising:
compressing the refrigerant in the compressor;
rejecting heat from the compressed refrigerant in the heat rejection heat exchanger;
passing a flow of the refrigerant through the primary ejector inlet;

passing a secondary flow of the refrigerant through the secondary inlet to merge with the primary flow;

sensing one or more operational parameters; and responsive to the sensed operational parameters causing the actuator to drive the relative streamwise shift.

14. The method of claim 13 wherein:

the streamwise shift improves an efficiency of the ejector and a system COP.

15. The method of claim 13 wherein:

operation is controlled by a controller programmed to control operation of the actuator.

16. The ejector of claim 8 further comprising:

a needle mounted for reciprocal movement along the primary flowpath between a first position and a second position; and a needle actuator coupled to the needle to drive said movement of the needle relative to the motive nozzle.

17. The ejector of claim 3 wherein:

said range of motion (ΔL) is at least 0.1 of a mixer minimum diameter ($D_{MIX}$).

18. The ejector of claim 3 wherein:

said portion includes said ratio of 0.2-0.9.

19. The ejector of claim 3 wherein:

said range of motion is 0.3-2.0 of a mixer minimum diameter ($D_{MIX}$).

20. The ejector of claim 3 wherein:

an overall half angle along said length is 5-30°.

21. An ejector comprising: a primary inlet;

a secondary inlet;

an outlet;

a primary flowpath from the primary inlet to the outlet;

a secondary flowpath from the secondary inlet to the outlet;

a mixer convergent section downstream of the secondary inlet;

a motive nozzle surrounding the primary flowpath upstream of a junction with the secondary flowpath and having:

a throat; and an exit; and a needle mounted for reciprocal movement along the primary flowpath between a first position and a second position;

a needle actuator coupled to the needle to drive said movement of the needle relative to the motive nozzle; and an actuator coupled to the motive nozzle to drive a relative streamwise shift of the motive nozzle exit and mixer convergent section, wherein:

the coupling is effective to provide said relative streamwise shift along a range of motion between a relatively extended condition and a relatively retracted condition;

over at least a portion of said range of motion, the exit is within the convergent section; the convergent section has a length (Lc);

the motive nozzle, in said portion of said range of motion, protrudes into the convergent section by an overlap (Lp); and said portion includes ratios of said overlap to said length including at least 0.4-0.7.

22. A refrigeration system comprising:

a compressor;

a heat rejection heat exchanger coupled to the compressor to receive refrigerant compressed by the compressor;

the ejector of claim 21;

a heat absorption heat exchanger; and a separator having:

an inlet coupled to the outlet of the ejector to receive refrigerant from the ejector;

a gas outlet; and a liquid outlet.

* * * * *